US006739700B2

(12) United States Patent
Dante et al.

(10) Patent No.: US 6,739,700 B2
(45) Date of Patent: May 25, 2004

(54) INKJET PRINTHEAD WITH HIGH NOZZLE TO PRESSURE ACTIVATOR RATIO

(75) Inventors: Henry M. Dante, Midlothian, VA (US); A. Clifton Lilly, Jr., Chesterfield, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 10/309,158

(22) Filed: Dec. 4, 2002

(65) Prior Publication Data

US 2003/0081064 A1 May 1, 2003

Related U.S. Application Data

(62) Division of application No. 09/761,768, filed on Jan. 18, 2001.

(51) Int. Cl.[7] ..... B41J 2/14
(52) U.S. Cl. ..... 347/48
(58) Field of Search ..... 347/48

(56) References Cited

U.S. PATENT DOCUMENTS

| | | | |
|---|---|---|---|
| 4,164,745 | A | 8/1979 | Cielo et al. |
| 4,275,290 | A | 6/1981 | Cielo et al. |
| 4,475,113 | A | 10/1984 | Lee et al. |
| 4,641,153 | A | 2/1987 | Cruz-Uribe |
| 4,870,433 | A | 9/1989 | Campbell et al. |
| 4,992,808 | A | 2/1991 | Bartky et al. |
| 5,023,625 | A | 6/1991 | Bares et al. |
| 5,059,989 | A | 10/1991 | Eldridge et al. |
| 5,124,720 | A | 6/1992 | Schantz |
| 5,144,341 | A | 9/1992 | El Haten et al. |
| 5,300,968 | A | 4/1994 | Hawkins |
| 5,495,270 | A | 2/1996 | Burr et al. |
| 5,622,897 | A | 4/1997 | Hayes |
| 5,808,639 | A | 9/1998 | Silverbrook |
| 5,812,159 | A | 9/1998 | Anagnostopoulos et al. |
| 5,841,449 | A | 11/1998 | Silverbrook |
| 5,841,452 | A | 11/1998 | Silverbrook |
| 6,017,117 | A | 1/2000 | McClelland et al. |
| 6,126,270 | A | 10/2000 | Lebens et al. |
| 6,250,740 | B1 | 6/2001 | Moghadam et al. |
| 6,354,695 | B1 | 3/2002 | Kim et al. |
| 6,533,395 | B2 * | 3/2003 | Dante et al. ..... 347/48 |

OTHER PUBLICATIONS

Notification of Transmittal of the International Search Report or the Declaration dated Jun. 4, 2002 for PCT/US02/00028.

Notification of Transmittal of International Preliminary Examination Report for PCT/US02/00028 dated Jun. 6, 2003.

* cited by examiner

*Primary Examiner*—Stephen D. Meier
*Assistant Examiner*—Alfred Dudding
(74) *Attorney, Agent, or Firm*—Burns, Doane, Swecker & Mathis, LLP

(57) ABSTRACT

An on-demand inkjet printhead includes an ink chamber provided with a plurality of nozzles and a single piezoelectric actuator for increasing pressure of ink within the chamber. Each nozzle is equipped with a heater element. Ink is ejected from selected nozzles of the printhead by energizing the heater elements of the selected nozzles to reduce surface tension and viscosity of ink at the selected nozzles, and applying an actuation voltage to the piezoelectric actuator to generate a pressure pulse in the ink within the ink chamber that ejects ink droplets from the selected nozzles but not from the non-selected nozzles. The ink chamber can also be provided with a plurality of piezoelectric actuators, each of which can be actuated independently.

20 Claims, 9 Drawing Sheets

INKJET PRINTHEAD WITH HIGH NOZZLE TO PRESSURE ACTIVATOR RATIO

This application is a divisional of application Ser. No. 09/761,768, filed on Jan. 18, 2001.

BACKGROUND OF THE INVENTION

1. Field of the Invention

The present invention relates generally to inkjet printhead design and operation, and in particular to DOD (Drop-On-Demand) inkjet printheads.

2. Description of Related Art

Various types of DOD inkjet printhead nozzles are known in the art. See, for example, U.S. Pat. No. 5,808,639 to Silverbrook.

One type of inkjet, commonly referred to as "bubblejet", features a printhead having a plurality of nozzles. In a typical bubblejet printhead, each nozzle is connected to a separate ink chamber in the printhead, and each chamber is provided with a heater element and filled with ink. To eject a drop of ink from the nozzle, the heater element in the chamber is energized until ink in the chamber near the heater element vaporizes to form a bubble, which increases pressure on the ink in the chamber and expels ink from the nozzle. See for example U.S. Pat. No. 5,841,452 to Silverbrook. Disadvantages of this approach include, for example, relatively large energy requirements and cumulative damage to the printhead caused by mechanical shock when the bubble cools and collapses. In addition, specialized inks must be used that are capable of enduring this thermal cycling without losing inking properties, forming undesirable residues within the chamber, and so forth.

In another type of inkjet mechanism, each nozzle in a printhead has one or more piezoelectric transducers arranged in a chamber or passageway that transports ink to the nozzle. When a piezoelectric transducer corresponding to a nozzle is activated with an electrical pulse of appropriate voltage and duration, it generates pressure pulse in the ink that expels a drop of ink from nozzle. Thus, the printhead can be operated by selectively activating piezoelectric transducers corresponding to various nozzles in the printhead. See for example U.S. Pat. No. 4,992,808 to Bartky, et al. However, it can be difficult and expensive to manufacture such a printhead with a high nozzle density due to the small size of the piezoelectric transducers.

In yet another type of inkjet mechanism, ink is supplied to nozzles in a printhead at a constant pressure. Viscosity and surface tension of the ink allow the ink to fill each nozzle, but are sufficient to prevent the ink from exiting the nozzle. Each nozzle is equipped with an electrically activated heater. Ink droplets are released from the printhead by selectively activating nozzle heaters to provide heat sufficient to lower the viscosity and surface tension of the ink and allow the ink to leave the nozzles. See for example U.S. Pat. No. 4,164,745 to Cielo, et al. and U.S. Pat. No. 5,812,159 to Anagnostopoulos, et al. However, to function effectively this technique can require inks that have a large change in viscosity and surface tension per unit of temperature change. In addition, it is less well suited to situations where the print medium is located at a distance from the printhead so that an ink drop must detach from the printhead and travel ballistically, instead of simply extending from the nozzle to contact the print medium (as shown for example in FIGS. 1 and 4 of U.S. Pat. No. 4,164,745 to Cielo, et al.).

Accordingly, a need exists for an inkjet printhead that is versatile, robust, simple and inexpensive to manufacture, with a high nozzle density and a short cycle time.

SUMMARY OF THE INVENTION

In accordance with exemplary embodiments of the present invention, an ink chamber in a printhead is provided with a plurality of nozzles and at least one piezoelectric actuator for increasing pressure of ink within the chamber. Each nozzle is equipped with a heater element, and the number of nozzles exceeds the number of piezoelectric actuators. Having multiple nozzles per piezoelectric actuator instead of one nozzle per piezoelectric actuator reduces manufacturing costs and increases simplicity and reliability of the printhead. This is because larger piezoelectric actuators are easier to manufacture, install and operate, and fewer piezoelectric actuators are required in the printhead. In addition, using larger and fewer piezoelectric actuators allows larger ink chambers to be formed within the printhead, which reduces or eliminates ink clogs in the printhead and eases clearing of clogs that do occur.

BRIEF DESCRIPTION OF THE DRAWINGS

Other objects and advantages of the invention will become apparent to those skilled in the art from the following detailed description of preferred embodiments, when read in conjunction with the accompanying drawings. Like elements in the drawings have been designated by like reference numerals.

DETAILED DESCRIPTION OF THE INVENTION

Figure 1:
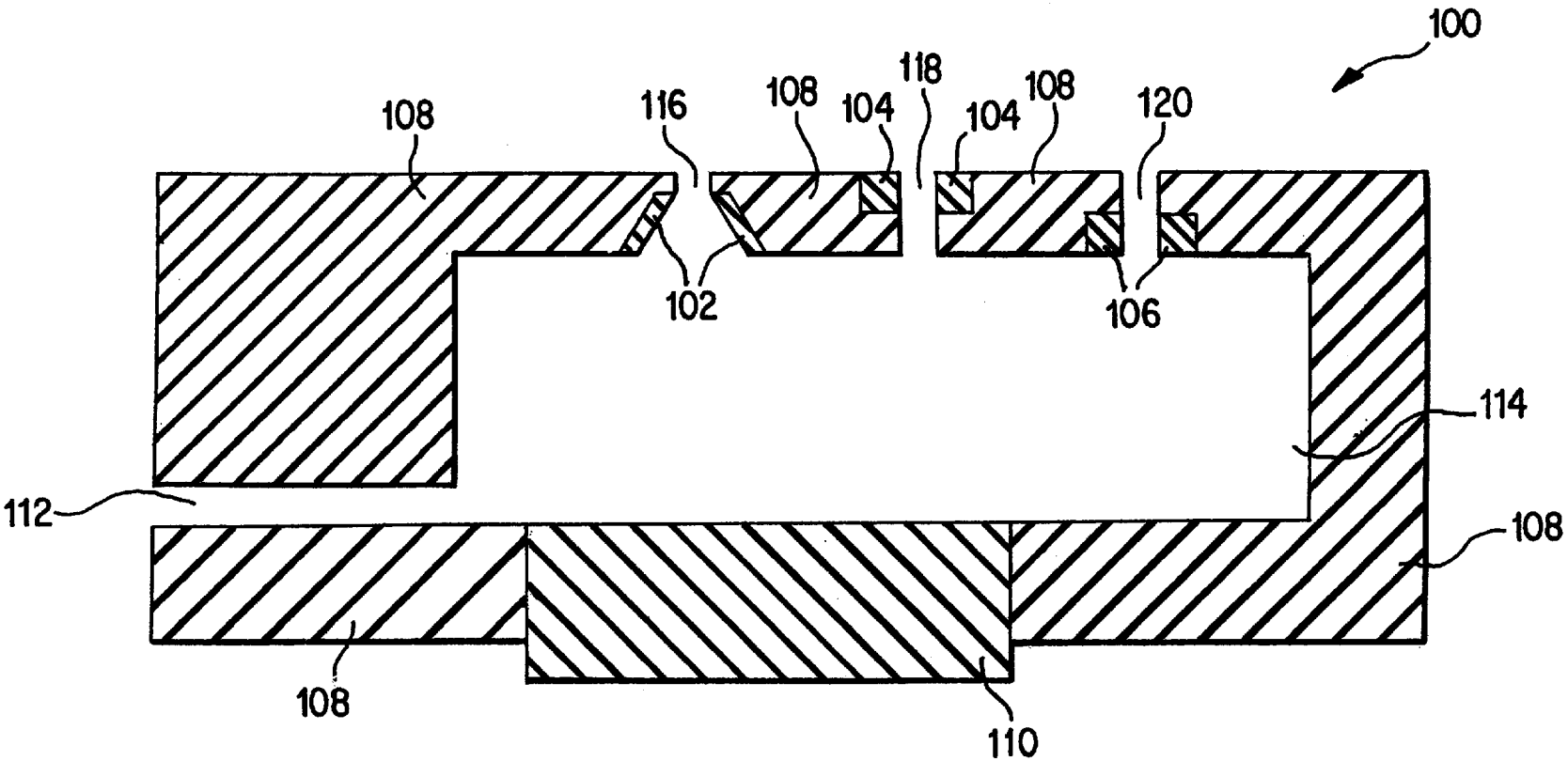
FIG. 1 shows a printhead in accordance with an embodiment of the present invention.

FIG. 1 shows an exemplary embodiment of the present invention. As shown in FIG. 1, a printhead 100 includes a chamber 114 formed with sidewalls 108 and a piezoelectric actuator 110 that also forms a sidewall portion of the chamber 114. An ink feed passage 112 supplies ink to the chamber 114. One face of the sidewalls 108 of the chamber 114 also includes nozzles 116, 118 and 120 from which ink can be expelled onto a print medium. Each nozzle is equipped with a heater element. In particular, the nozzle 116 has a heater element 102, the nozzle 118 has a heater element 104, and the nozzle 120 has a heater element 106.

Different nozzle configurations and heater configurations can be used, including the different configurations shown in FIG. 1. For example, the heater elements can be placed at different locations in a nozzle, and can be annular to extend around an inner circumference of the nozzle, or can extend part way around the nozzle. Although only 3 nozzles are shown in FIG. 1, in accordance with embodiments of the invention, an ink chamber can be provided with any number of nozzles, e.g., hundreds or thousands of nozzles. Thus, the ink chamber's ratio of nozzles to piezoelectric actuators can range as high as several thousand, or higher.

Figure 6:
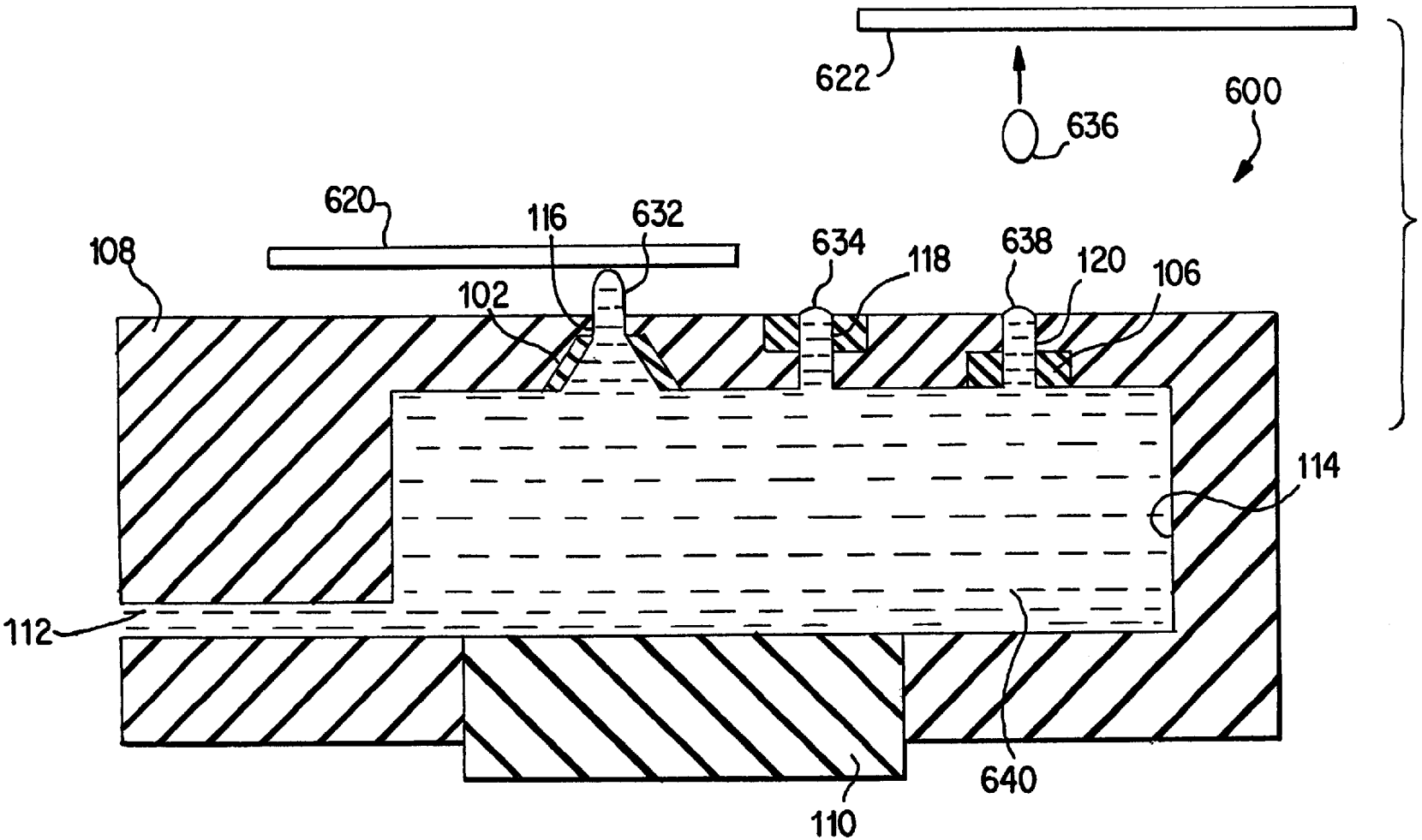
FIG. 6 shows the printhead of FIG. 1 in operation.

FIG. 6 shows the printhead of FIG. 1 in action. The chamber is filled with ink 640, the piezoelectric actuator 110 has generated pressure on the ink 640, and the heater 102 of the nozzle 116 has been energized. A combination of increased ink pressure from the piezoelectric actuation 110, together with lowered ink viscosity and surface tension caused by the increased ink temperature at the nozzle 116, allows an ink drop 632 to emerge from the nozzle 116 and contact a print medium 620.

The nozzles 118 and 120 are not energized, so the pressure increase caused by the piezoelectric actuator is not enough to overcome ink viscosity and surface tension at the nozzles and eject or expel ink from the nozzles 118 and 120. Instead, the ink forms menisci 634, 638 at the nozzles 118, 120.

FIG. 6 also shows an ink droplet 636 in flight towards a print medium 622, that was ejected from the nozzle 120 on a previous cycle (when the piezoelectric actuator 110 and the nozzle heater 106 of the nozzle 120 were actuated).

Figure 2:
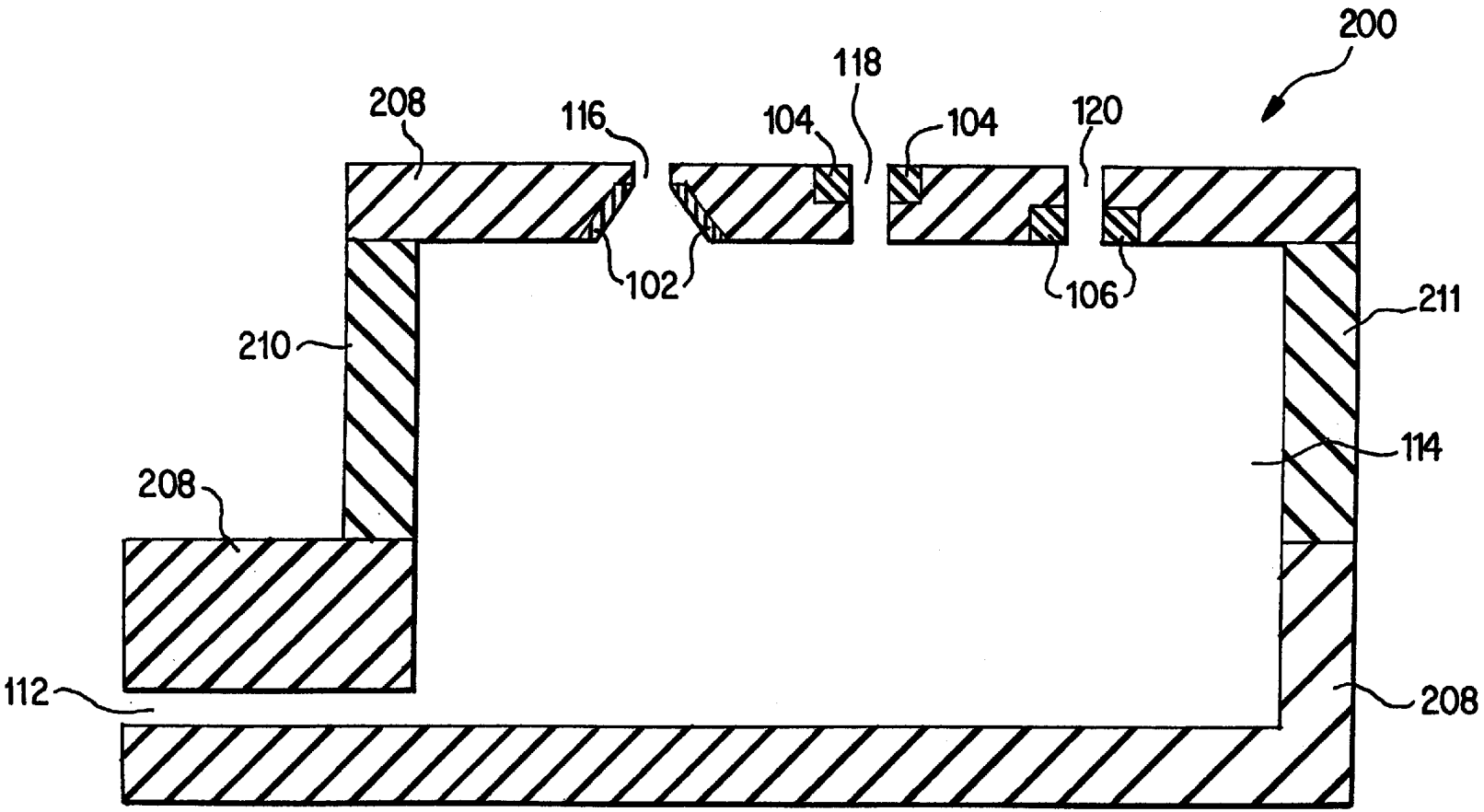
FIG. 2 shows a printhead in accordance with an embodiment of the present invention.

FIG. 2 shows another embodiment of the present invention, that is similar to the embodiment shown in FIG. 1. The printhead 200 is formed of sidewalls 208, 209 and of two piezoelectric actuators 210, 211 that also form sidewalls of the printhead 200. The nozzles 116, 118, 120 are provided in the sidewall 209.

In accordance with an exemplary embodiment of the invention, the printhead 200 can be designed so that the printhead will function properly during normal operations using only one of the piezoelectric actuators. In this situation, providing an ink chamber multiple piezoelectric actuators confers a number of advantages. For example, in the event one of the piezoelectric actuators is nonfunctional due to a manufacturing defect or later becomes nonfunctional, then the other piezoelectric actuator can be used to pump or expel ink through actuated chamber nozzles. Thus a higher rate of manufacturing defects can be tolerated, which typically lowers manufacturing costs, and/or improves the overall reliability of the printhead.

In addition, multiple piezoelectric actuators also allow the printhead to be operated with greater flexibility. For example, when a large number of nozzles in the chamber are simultaneously actuated (by energizing their respective nozzle heaters) to allow ejection of ink droplets, both piezoelectric actuators can be actuated together to ensure that there is sufficient pressure to properly expel ink from all the actuated nozzles.

The piezoelectric actuators can also be actuated sequentially. For example, in situations where nozzles will be sequentially activated or actuated in a continuous fashion and there is a limitation on how fast the ink chamber 114 can be refilled, the piezoelectric actuators can also be actuated sequentially so that the first piezoelectric actuator reduces the volume in the ink chamber 114, and then the second piezoelectric actuator further reduces the volume in the ink chamber 114, to maintain an appropriate pressure in the ink chamber as ink exits the chamber via the actuated nozzles. In addition, when power supply voltages are limited, multiple piezoelectric actuators can be driven using a lower voltage, to perform the same task that a single piezoelectric actuator supplied with a higher voltage would otherwise perform.

Although only two piezoelectric actuators are shown in FIG. 2, the printhead 200 can be provided with more than two piezoelectric actuators to reduce the volume in the ink chamber 114 or increase pressure on ink in the ink chamber 114 when actuated.

Figure 3:
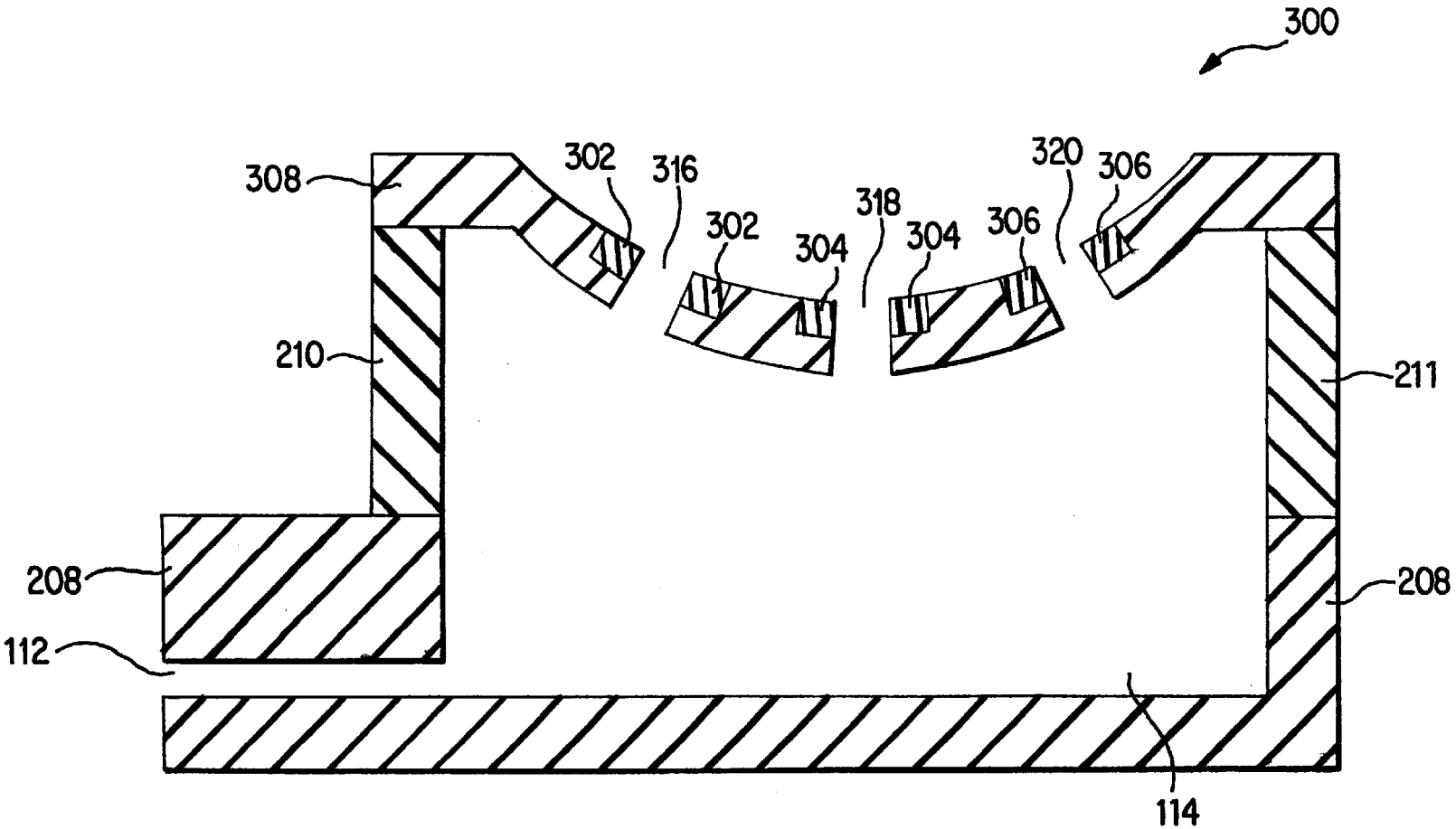
FIG. 3 shows a printhead in accordance with an embodiment of the present invention.

FIG. 3 shows a printhead 300 in accordance with another embodiment of the present invention, that is similar to the printhead 200 but has a curved sidewall 308 with nozzles 316, 318, 320 equipped with heater elements 302, 304, 306. This printhead configuration is well suited to printing images onto curved surfaces, for example cigarettes, mailing tubes and so forth.

Figure 4:
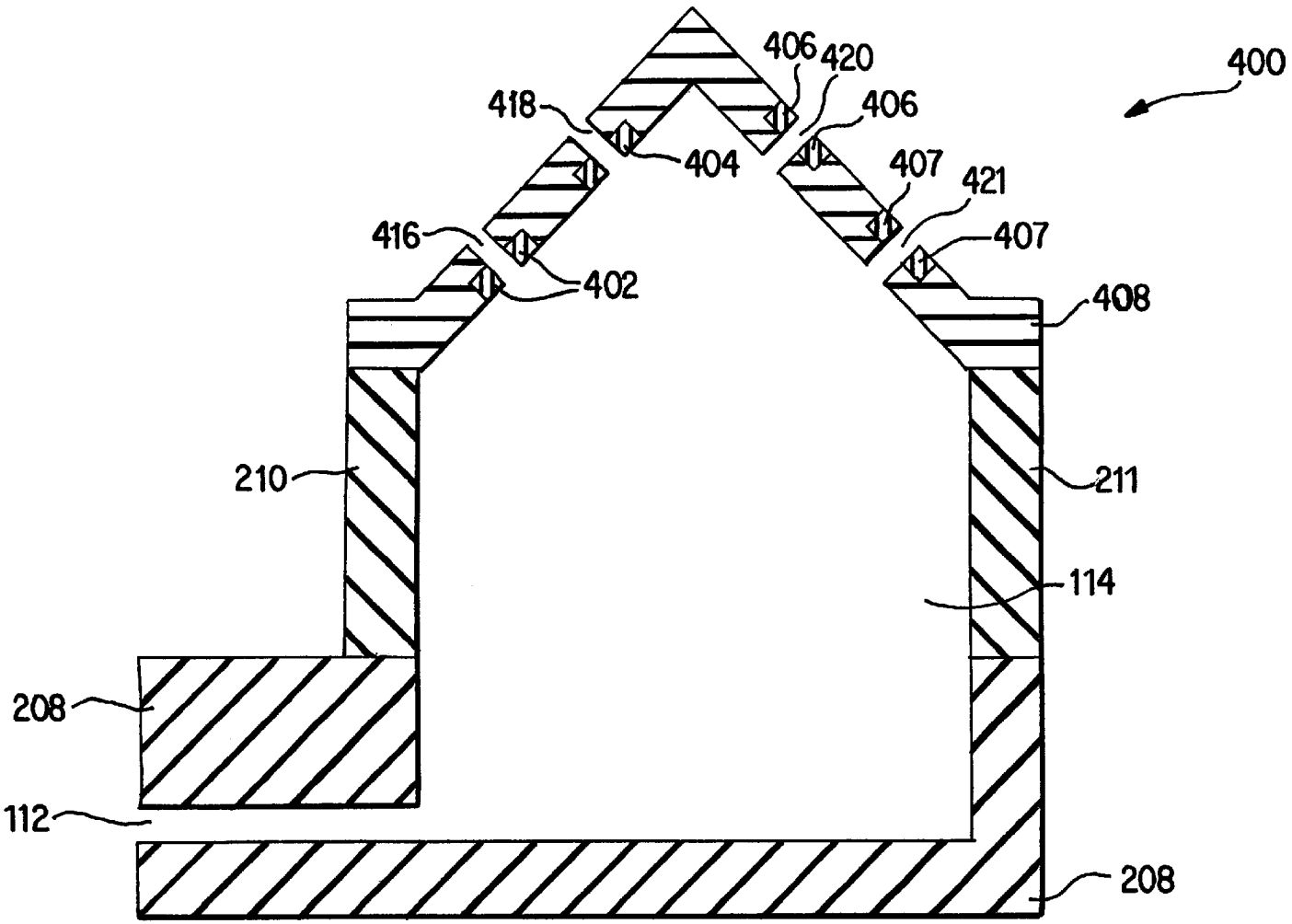
FIG. 4 shows a printhead in accordance with an embodiment of the present invention.

FIG. 4 shows a printhead 400 in accordance with another embodiment of the present invention, that is similar to the printhead 200 but has an angled sidewall 408 with nozzles 416, 418, 420 and 421 equipped with heater elements 402, 404, 406. This printhead configuration is well suited to printing images onto surfaces having intersecting planes and corners, or located in tight spaces. Of course, printheads in accordance with the present invention can be provided with other print nozzle surfaces having other shapes that are appropriate for printing images on corresponding objects.

Figure 5A:
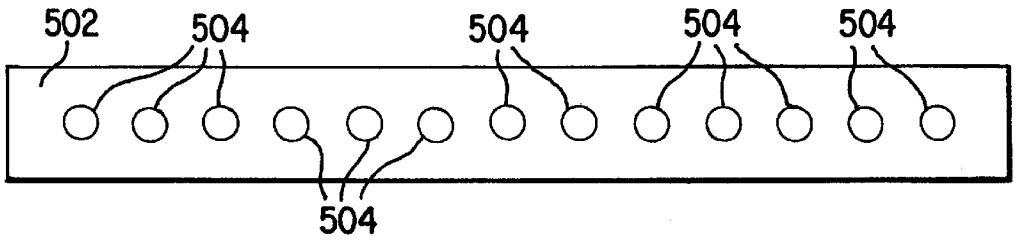
FIGS. 5A, 5B show exemplary nozzle layouts in accordance with an embodiment of the present invention.
Figure 5B:
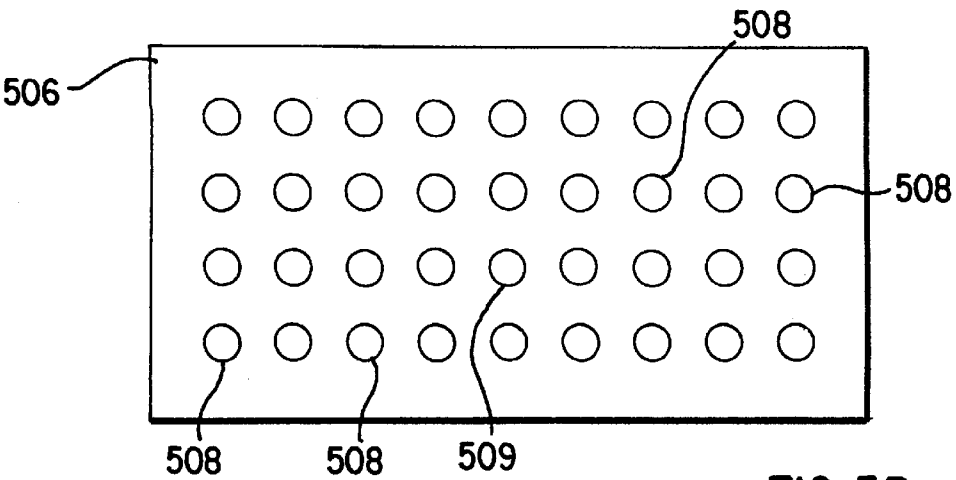

FIGS. 5A and 5B show end views of printheads having nozzles arranged in accordance with embodiments of the invention, looking into the nozzles. FIG. 5A shows a printhead 502 having a single line of thirteen nozzles 504, and FIG. 5B shows a printhead 506 having thirty-six nozzles 508 arranged in a four-by-nine grid pattern. As those of ordinary skill in the art will appreciate, the nozzles can be arranged in any appropriate pattern, and as indicated further above the printhead can be configured with any appropriate number of nozzles.

Figure 7:
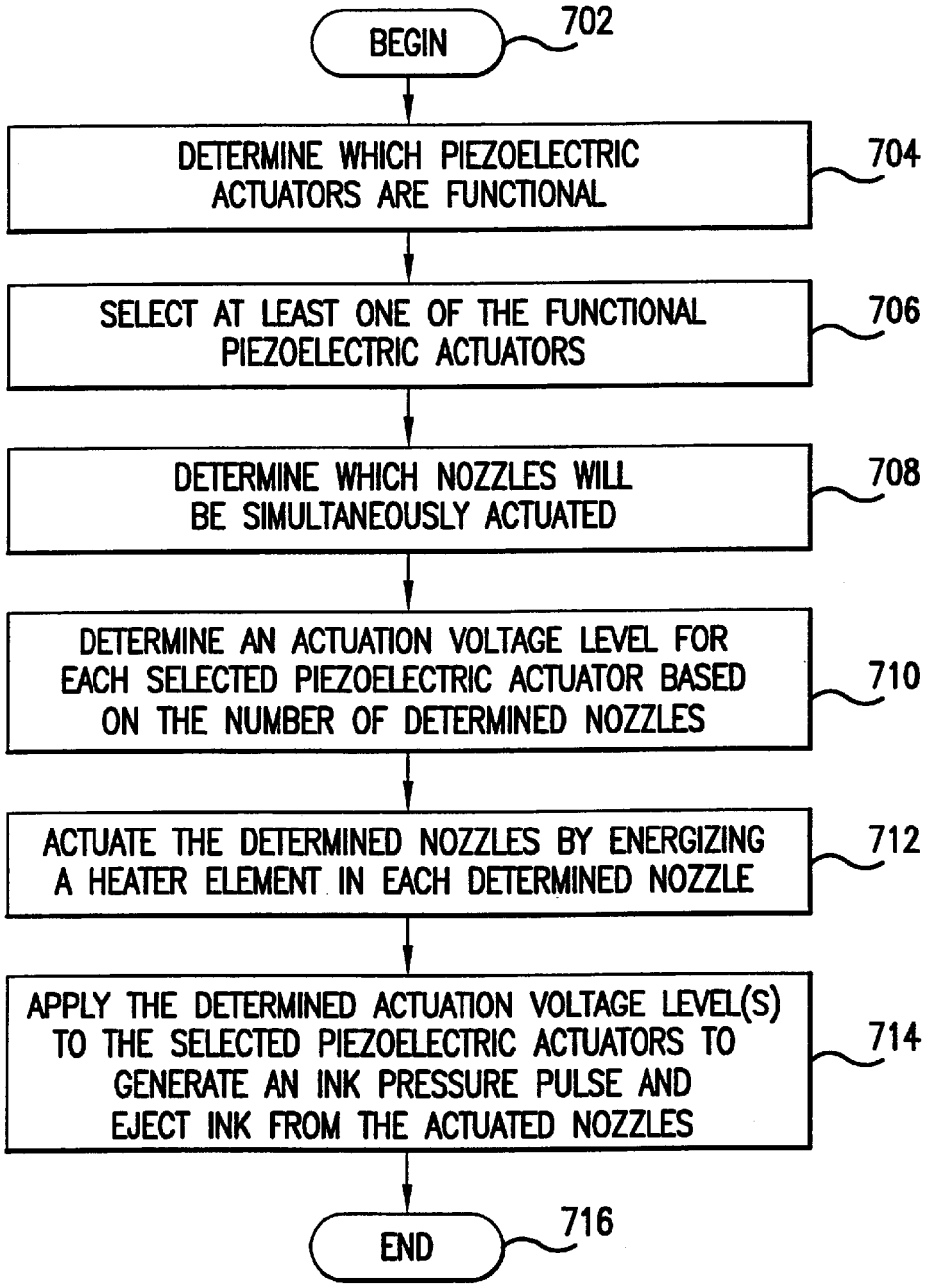
FIG. 7 shows an exemplary flowchart in accordance with an embodiment of the present invention.

FIG. 7 shows an exemplary flowchart in accordance with various embodiments of the present invention described above, with reference to an inkjet printhead having an ink chamber with one or more piezoelectric actuators and a plurality of nozzles and nozzle heater elements. As shown in FIG. 7, control flows from step 702 to step 704, where a determination is made as to which piezoelectric actuators corresponding to an ink chamber in an inkjet printhead are functional. A piezoelectric actuator might be non-functional due to a manufacturing defect, for example. From step 704 control flows to step 706, where at least one of the functional piezoelectric actuators is selected for use during normal operation of the inkjet printhead. From step 706 control flows to step 708, where a determination is made as to which nozzles corresponding to the ink chamber will be simultaneously actuated, for example in a step of a printing sequence. From step 708 control flows to step 710, where actuation voltage levels for the selected, functional piezoelectric actuators are determined, based for example on the number of nozzles determined in step 708. To ensure sufficient pressure during an ink pressure pulse, the actuation voltage levels can be larger when more nozzles are simultaneously actuated, to compensate for the increased flow of ink out of the ink chamber via the actuated nozzles. Thus, the actuation voltage level can vary depending on the number of determined nozzles. Alternatively, the actuation voltage level can be held constant regardless of the number of determined nozzles. However, changing the actuation levels has the advantage of precisely controlling the chamber volume based upon the number of nozzles fired, e.g., higher activation level when the number of nozzles is larger. From step 710 control flows to step 712, where the determined nozzles are actuated by energizing the heater elements corresponding to the determined nozzles. From step 712, control flows to step 714 where the determined actuation voltage levels are applied to the selected piezoelectric actuators, to generate a pressure pulse in the ink within the ink chamber to eject ink from the actuated nozzles. Step 712 can alternatively be placed after step 714, or can occur simultaneously with or overlapping with step 714. From the last of steps 712 and 714, control proceeds to step 716 where the process ends. All or part of the process can be repeated for each step in a printing sequence.

Figure 8:
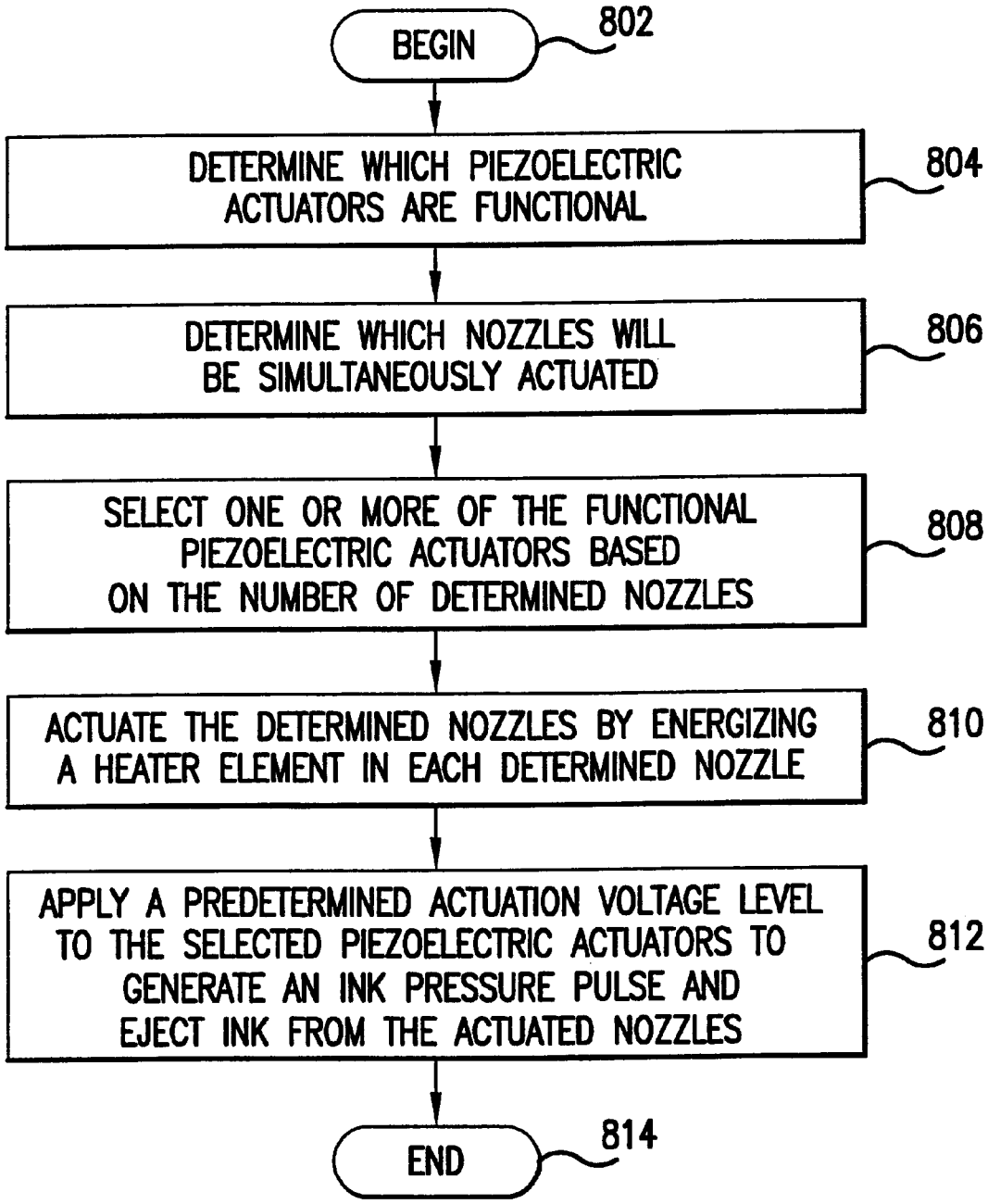
FIG. 8 shows an exemplary flowchart in accordance with an embodiment of the present invention.

FIG. 8 shows another exemplary flowchart in accordance with various embodiments of the present invention described above, with reference to an inkjet printhead having an ink chamber with one or more piezoelectric actuators and a plurality of nozzles and nozzle heater elements. As shown in FIG. 8, control flows from step 802 to step 804, where a determination is made as to which piezoelectric actuators corresponding to an ink chamber in an inkjet printhead are functional. A piezoelectric actuator might be non-functional due to a manufacturing defect, for example. From step 804 control flows to step 806, where a determination is made as to which nozzles corresponding to the ink chamber will be simultaneously actuated, for example in a step of a printing sequence. From step 806 control flows to step 808, where one or more of the functional piezoelectric actuators are selected based on how many of the nozzles will be simultaneously actuated. For example, where a large number of nozzles will be simultaneously actuated, then multiple piezoelectric actuators can be selected for actuation to ensure that the ink pressure pulse level will be sufficiently high despite greater ink flow out of the ink chamber due to the large number of actuated nozzles. Alternatively, the number of selected piezoelectric actuators can be constant, regardless of how many of the nozzles will be simultaneously actuated. From step 808, control flows to step 810, where the determined nozzles are actuated by energizing the heater elements corresponding to the determined nozzles. From step 810, control flows to step 812 where predetermined actuation voltage levels are applied to the selected piezoelectric actuators, to generate a pressure pulse in the ink within the ink chamber to eject ink from the actuated nozzles. Step 810 can alternatively be placed after step 812, or can occur simultaneously with or overlapping with step 812. All or part of the process can be repeated for each step in a printing sequence.

Figure 9:
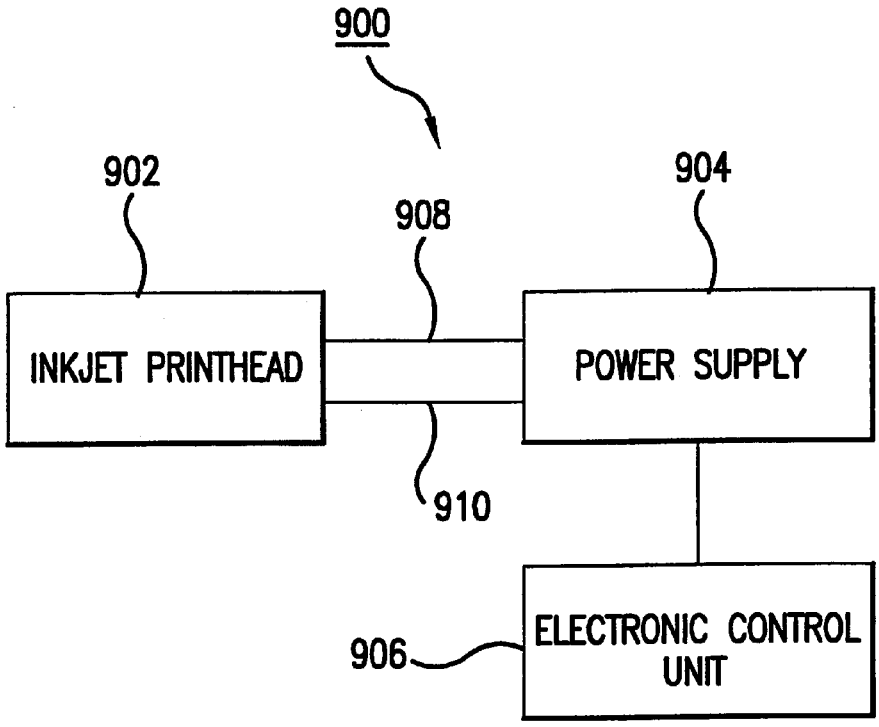
FIG. 9 shows a block diagram of an exemplary system incorporating an inkjet printhead in accordance with embodiments of the present invention.

FIG. 9 shows a block diagram of an exemplary system 900 incorporating an inkjet printhead 902 in accordance with embodiments of the present invention. The printhead 902 is connected to an electronic power supply 904 via a first power cable or power line 908 and a second power cable or power line 910. The first power cable 908 can selectively provide electrical power to nozzle heaters in the printhead 902, and the second power cable 910 can selectively provide electrical power to piezoelectric actuators in the printhead 902. An electronic control unit 906 connected to the power supply 904 controls the supply of power to the printhead 902 via the cables 908, 910. The system 900 can be part of a printing device for example, and the control unit 906 can be a microprocessor in the printing device that also performs other tasks. The power supply 904 can be part of or separate from a central power supply in the printing device.

In accordance with various embodiments of the present invention, exemplary inks preferably have a viscosity that decreases by roughly a factor of 3 when temperature of the ink is raised from about 10° C. to between about 15 and 20° C. Of course, other temperatures and temperature differentials can be used, as well as other inks having different ink viscosities and viscosity differentials in accordance with different configurations and applications of the present invention. Typical nozzle diameters are between 20 microns and 50 microns, and can range between 10 microns and 100 microns. Other appropriate nozzle diameters are also possible, and can vary, for example, according to desired print image quality or resolution, and according to properties and characteristics of the particular ink being used. Nozzle density is typically between 200 and 300 nozzles per inch in a row, and can be as high as 600 nozzles per linear inch. Other nozzle densities are also possible. The piezoelectric actuator(s) in the printhead can be quite large. In a printhead having a print region that is one foot square, the piezoelectric material in an actuator can measure, for example, two inches on each of two or more sides.

The piezoelectric actuator can be operated or cycled in exemplary embodiments of the present invention at frequencies on the order of 10 kilohertz. As those of ordinary skill in the art will recognize, the piezoelectric actuators can be appropriately operated with power supply voltage levels ranging from several volts to thousands of volts, depending on particular configurations and applications of the printhead.

Since both piezoelectric actuators and heater elements typically have a linear response to an input or driving voltage signal, operating parameters for a printhead using a specific ink can be determined in different ways. For example, a first voltage and time duration can be set with respect to a heater element, and a low initial second voltage can be set for the piezoelectric actuator. Then after each cycle where the first, preset voltage is applied to the heater element for the preset time duration and the second voltage is applied to the piezoelectric actuator and then removed, the second voltage can be increased slightly. This can be continued until the nozzle corresponding to the heater element ejects ink, thus establishing a low threshold for the second voltage. The second voltage can then be further increased with successive cycles, during which the heater element is not energized. This can be continued until energizing the piezoelectric actuator causes the nozzle to eject ink even when no power is applied to the heater element, thus establishing a high threshold for the second voltage. The second voltage for actuating the piezoelectric actuator can then be set at a value between the low and high thresholds, that is appropriate for normal operation of the printhead. The low and high thresholds can be, for example, 10 volts and 20 volts respectively.

Alternatively, the actuating voltage for the piezoelectric actuator can be fixed at a selected value, and the first voltage applied to the heater element (and also it's time duration) can be varied, to explore operating regions and select parameters that are appropriate for normal operation or specific application of the printhead. Similar techniques can also be used to determine actuating voltage levels for one or more piezoelectric actuators, corresponding to different numbers of nozzles that are simultaneously actuated (e.g., heated by their respective heater elements). In other words, an appropriate actuating voltage level for one or more piezoelectric actuators can differ depending on how many nozzles and/or piezoelectric actuators are simultaneously actuated.

Timing of piezoelectric actuation relative to nozzle actuation can also vary depending on specific printhead configurations and applications. For example, where nozzle actuation can be accomplished faster than piezoelectric actuation, the nozzle actuation can be started after the piezoelectric actuation begins so that the ink at the nozzle will reach an optimum temperature at an appropriate time during the pressure pulse generated by the piezoelectric actuator. Different nozzles can also be sequentially activated during a single pressure pulse, for example. Thus, using both piezoelectrically generated pressure pulses and selective activation of nozzle heaters (nozzle actuation) allows the printhead to be tremendously versatile.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. Method for applying ink to a print medium using an inkjet printhead comprising an ink chamber containing ink and including a plurality of nozzles provided in at least one sidewall of the ink chamber and including first and second piezoelectric actuators, wherein each nozzle comprises a heater element, the method comprising:

actuating selected ones of the plurality of nozzles by activating the heater elements of the selected nozzles; and sequentially actuating a) the first and second piezoelectric actuators to expel ink from the selected nozzles, or b) at least two of the selected nozzles while actuating one of the first and second piezoelectric actuators.

2. The method of claim 1, wherein the selected nozzles are actuated sequentially.

3. The method of claim 1, wherein the selected nozzles are actuated in a continuous fashion.

4. The method of claim 1, comprising:

sequentially actuating at least two of the selected nozzles while actuating one of the first and second piezoelectric actuators.

5. The method of claim 1, comprising:

sequentially actuating the first and second piezoelectric actuators to expel ink from the selected nozzles.

6. The method of claim 1, comprising:

selecting ones of the plurality of nozzles for actuation.

7. Method for determining actuation voltage thresholds of an inkjet printhead comprising an ink chamber including a plurality of nozzles provided in at least one sidewall of the ink chamber and including a piezoelectric actuator, wherein each nozzle comprises a heater element, the method comprising:

applying a first actuation voltage to the piezoelectric actuator; and incrementing the first actuation voltage until ink is expelled from an un-actuated one of the plurality of nozzles.

8. The method of claim 7, comprising:

actuating at least one of the plurality of nozzles;

applying a second actuation voltage to the piezoelectric actuator; and incrementing the second actuation voltage until ink is expelled from the actuated at least one of the plurality of nozzles.

9. The method of claim 8, wherein the actuating of the at least one of the plurality of nozzles comprises applying a third voltage to a heater element of the at least one of the plurality of nozzles.

10. The method of claim 9, comprising:

varying the third voltage before incrementing the second actuation voltage.

11. A printing apparatus, comprising:

an inkjet printhead comprising an ink chamber, first and second piezoelectric actuators arranged to alter ink pressure within the ink chamber, and a plurality of nozzles provided in at least one sidewall of the ink chamber, each nozzle comprising a heater element;

a power supply connected to independently supply electrical power to the heater elements and the piezoelectric actuator; and an electronic control unit arranged to a) direct the power supply to supply electrical power to the heater elements of selected ones of the plurality of nozzles, and b) direct the power supply to sequentially supply electrical power to the first and second piezoelectric actuators or sequentially supply electrical power to the heater elements of at least two of the selected nozzles while actuating one of the first and second piezoelectric actuators.

12. The printing apparatus of claim 11, wherein the electronic control unit is arranged to direct the power supply to supply electrical power sequentially to the heater elements of at least two of the selected nozzles.

13. The printing apparatus of claim 11, wherein the electronic control unit is arranged to direct the power supply to supply electrical power in a continuous fashion.

14. The printing apparatus of claim 11, wherein the electronic control unit is arranged to a) direct the power supply to supply electrical power sequentially to at least two of the selected nozzles and simultaneously supply electrical power to one of the first and second piezoelectric actuators.

15. The printing apparatus of claim 11, wherein the electronic control unit is arranged to select ones of the plurality of nozzles for actuation.

16. The printing apparatus of claim 11, wherein the electronic control unit is arranged to direct the power supply to sequentially supply electrical power to the first and second piezoelectric actuators.

17. A printing apparatus, comprising:

an inkjet printhead comprising an ink chamber, a piezoelectric actuators arranged to alter ink pressure within the ink chamber, and a plurality of nozzles provided in at least one sidewall of the ink chamber, each nozzle comprising a heater element;

a power supply connected to independently supply electrical power to the heater elements and the piezoelectric actuator; and an electronic control unit arranged to direct the power supply to a) apply a first voltage to the piezoelectric actuator, and b) increment the first voltage until ink is expelled from an un-actuated one of the plurality of nozzles.

18. The printing apparatus of claim 17, wherein the electronic control unit is arranged to direct the power supply to a) actuate at least one of the plurality of nozzles by applying electrical power to the corresponding heater element, b) apply a second voltage to the piezoelectric actuator, and increment the second actuation voltage until ink is expelled from the actuated at least one of the plurality of nozzles.

19. The printing apparatus of claim 18, wherein the electronic control is arranged to direct the power supply to actuate the at least one of the plurality of nozzles by a) applying a third voltage to the corresponding heater element, and b) varying the third voltage.

20. The printing apparatus of claim 19, wherein the electronic control is arranged to direct the power supply to varying the third voltage before incrementing the second actuation voltage.

* * * * *